United States Patent [19]

Volkert

[11] Patent Number: 4,963,125

[45] Date of Patent: Oct. 16, 1990

[54] METHOD OF MAKING PROMOTIONAL POP-UP

[75] Inventor: John K. Volkert, Northfield, Ill.

[73] Assignee: One-Up, Inc., Northfield, Ill.

[21] Appl. No.: 235,299

[22] Filed: Aug. 23, 1988

Related U.S. Application Data

[63] Continuation-in-part of Ser. No. 225,250, Jul. 28, 1988.

[51] Int. Cl.[5] ..... B31D 5/00; B31D 5/04

[52] U.S. Cl. ..... 493/334; 493/335; 493/344; 493/356; 493/346; 493/381; 493/944

[58] Field of Search ..... 493/331, 334, 344, 349, 493/356, 379, 386, 944, 955, 959, 335, 346, 381; 40/124.1, 530, 539; 428/9, 12, 13; 446/148

[56] References Cited

U.S. PATENT DOCUMENTS 2,152,299 3/1939 Arndt ..... 40/539

4,657,612 4/1987 Schoenleber et al. ..... 446/168

*Primary Examiner*—J. J. Hartman

*Assistant Examiner*—Jack Lavinder

*Attorney, Agent, or Firm*—Fitch, Even, Tabin & Flannery

[57] ABSTRACT

Promotional pieces including pop-up structures and methods for mass production on a web press or the like are disclosed. After manipulating the web to create a double thickness in a region of two pop-up panels, die-cutting of the double-thickness region creates an identical pattern along edges of these panels which creates a desired artistic effect found earlier in hand-assembled items. These pieces may have a pop-up structure which includes a tunnel-like construction having apertures formed along a hinge line between two panels. Die-cutting may also be performed along both edges of a pair of folded-over pop-up panels.

9 Claims, 2 Drawing Sheets

FIG 2
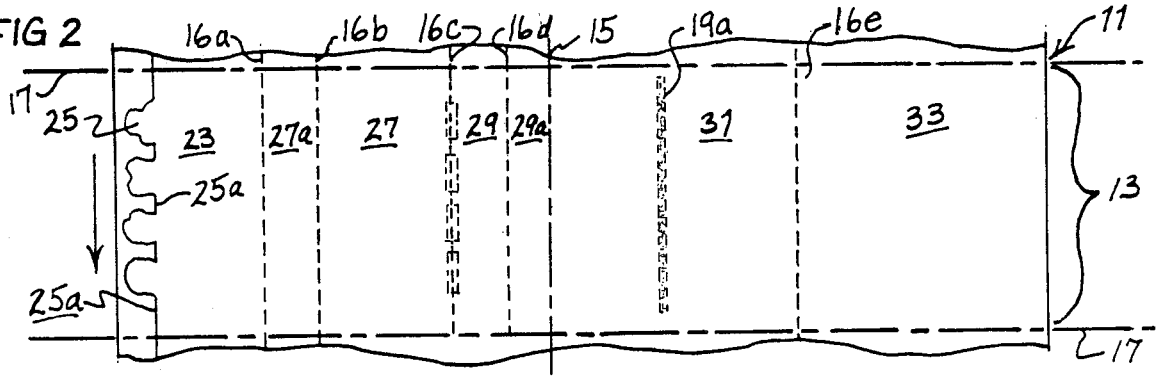
FIG 3A
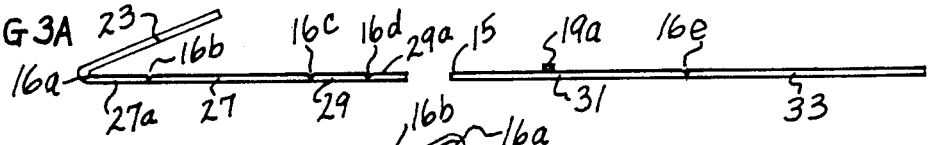
FIG 3B
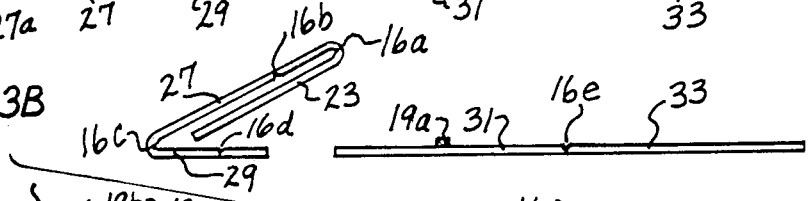
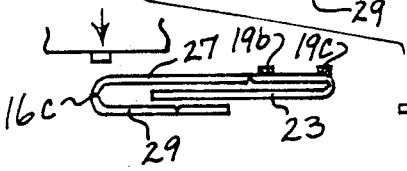
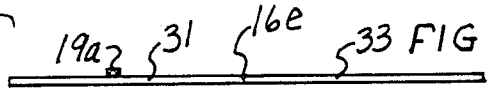
FIG 3C
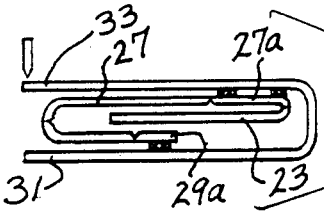
FIG 3E
FIG 3D
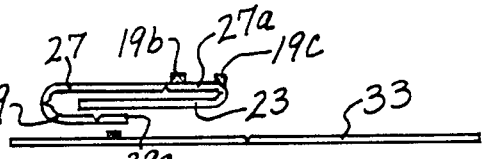
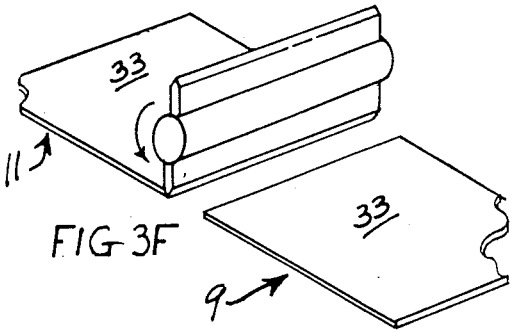
FIG 3F
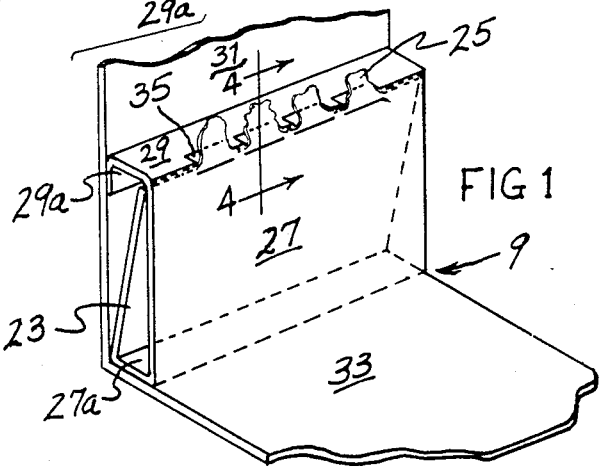
FIG 1
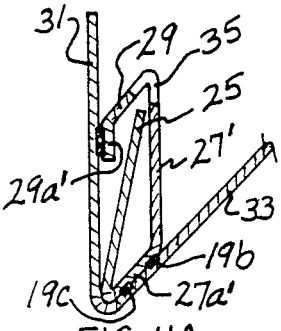
FIG 4A
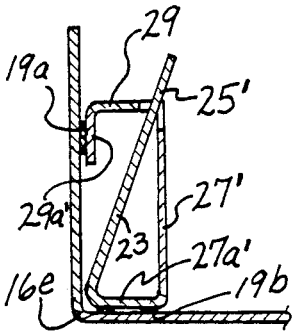
FIG 4B FIG. 5
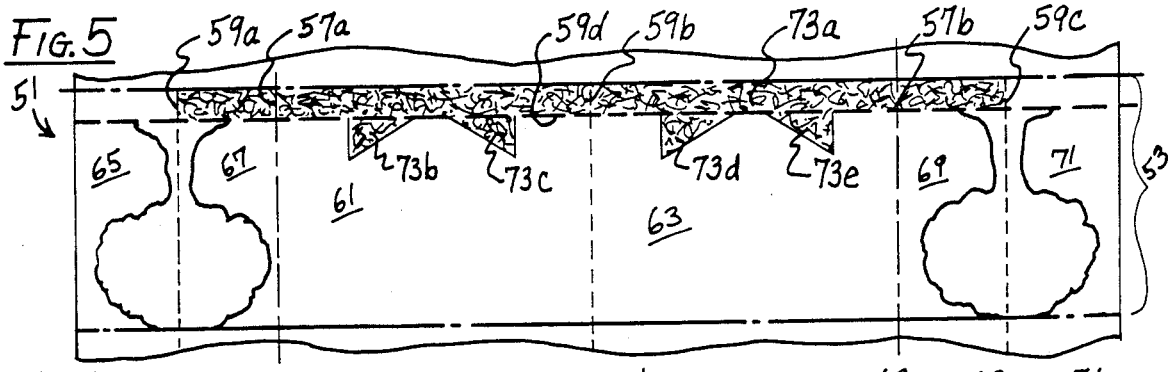
FIG. 6A
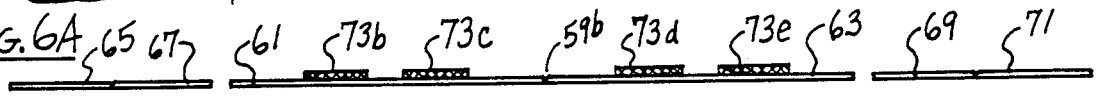
FIG. 6B
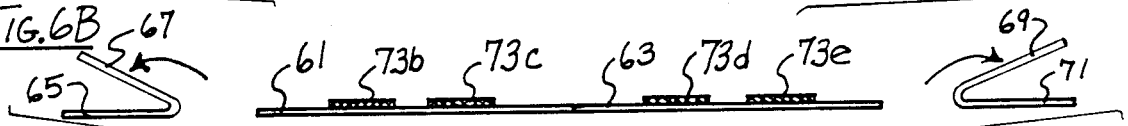
FIG. 6C
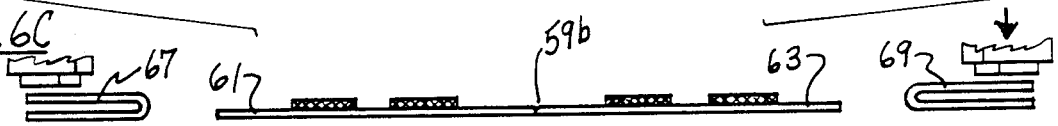
FIG. 6D
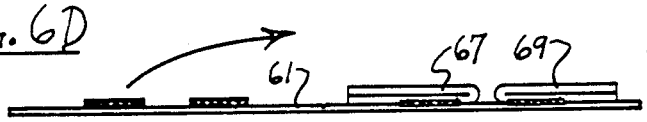
FIG. 6E
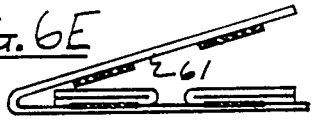
FIG. 6F
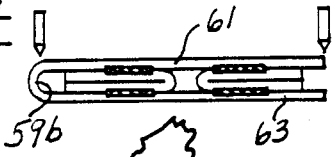
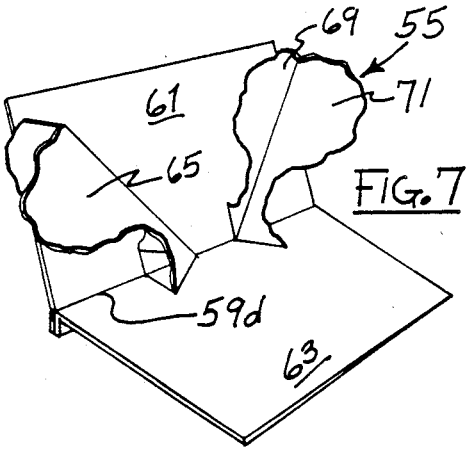
FIG. 7
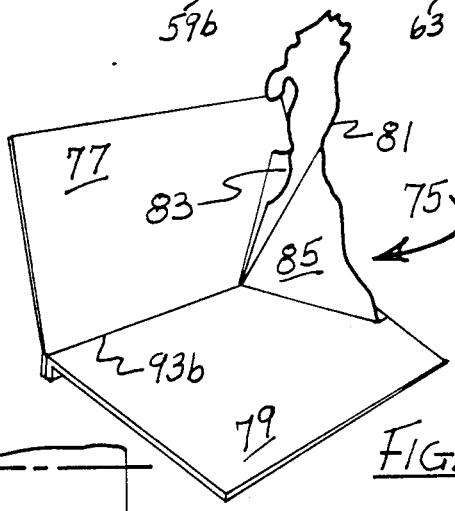
FIG. 8
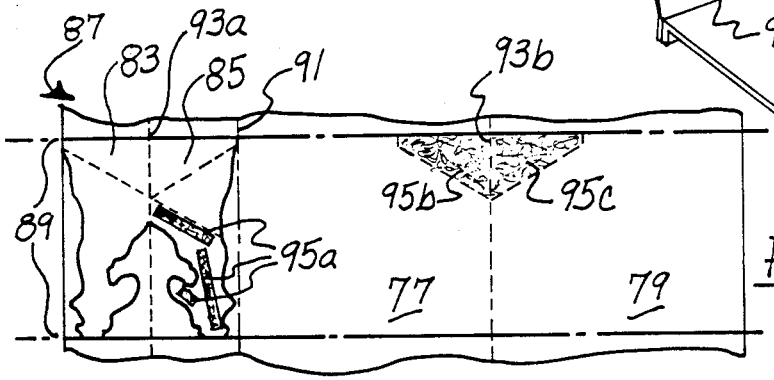
FIG. 9

METHOD OF MAKING PROMOTIONAL POP-UP

This application is a continuation-in-part of my earlier application Ser. No. 225,250, filed July 28, 1988, now pending.

This invention relates to the printed paper novelty items of various types. It more particularly relates to promotional items and to methods of making printed pieces on a web-press or the like, which pieces contain pop-ups of particular designs that move away from the plane of the piece upon opening.

BACKGROUND OF THE INVENTION

Pop-ups have fairly recently become frequently used in advertising and in other promotional endeavors, whereas they had been used in the greeting card field and in children's books for a number of years. Such pop-up pieces have become generally available to the advertising field as a result of the developments shown in several earlier patents, particularly U.S. Pat. No. 3,995,388, issued Dec. 7, 1976, which discloses methods for making pop-up paper products having significant advantages over hand-assembly methods that had been generally theretofore employed. U.S. Pat. No. 4,146,983, issued Apr. 3, 1979, discloses other methods for making novel promotional items, particularly those which are designed to present a plurality of coupons or the like to a recipient upon the opening of a folder. U.S. Pat. No. 4,337,589 discloses manufacturing techniques specifically suited for mass production on a web-press or the like for making pop-up advertising pieces and the like.

Although the foregoing patents describe workable manufacturing techniques for making such advertising and promotional pieces on a web-press or the like, die-cutting of such pieces has been restricted to areas of the blank set apart from lines along which creasing or folding occurs so as to avoid interfering with such folding operations. Development work has continued with respect to improving manufacturing methods and to providing other novel pop-up arrangements which are capable of manufacture on a web-press or the like, thus facilitating economical mass production at prices feasible to accommodate large-scale advertising or promotional presentations.

SUMMARY OF THE INVENTION

The present invention provides promotional pop-up pieces of this general character which are attractive and unusual in design and which are adapted for fabrication by mechanical mass production, particularly as part of a web-press operation or the like. More particularly, the invention provides methods for printing a series of structurally identical blanks as a part of a continuous web of paper being fed through a web-press, each of which blanks following completion of fabrication, produces a structurally identical piece containing a pop-up of particularly artistic design. By the application of adhesive to selected locations on the web and by manipulation of various segments of the web, pieces are created having a pop-up structure formed of pop-up panels which are die-cut along one or both edges and move into a protruding posture upon opening of the piece. More specifically, the methods allow an aperture to be formed in both panels of a pop-up structure along a hinge line therebetween and also allow panels which form an interconnected pop-up structure to be die-cut at the same time to thus permit more elaborate contouring. The double-thickness web allows greater tension to be maintained on the individual folded ribbons and increases the overall running speed. Opening of the piece causes the artistically aesthetic pop-up structure to rise up and away from the planes of a pair of the basepieces.

BRIEF DESCRIPTION OF THE DRAWINGS

FIG. 1 a perspective view of a pop-up promotional piece various features of the invention;

FIG. 2 is a portion of a continuous web which has been printed and die-cut to define a series of blanks containing pop-up panels and basepieces to which a glue line has also been applied;

FIGS. 3A–3F are a series of diagrammatic views illustrating the handling of a single blank portion of the web depicted in FIG. 2 to show the folding and other manipulating steps to which the continuous web is subjected as a part of an overall mass production method;

FIGS. 4A and 4B are sectional views, reduced in size, which illustrate the opening of the piece, and with FIG. 4B being taken along line 4—4 of FIG. 1;

FIG. 5 is a view similar to FIG. 2, of an alternative embodiment of continuous web that may be employed to produce a promotional piece by means of a method incorporating various features of the invention;

FIGS. 6A–6F are a series of diagrammatic views, similar to FIGS. 3A–3F, showing a method of handling the continuous web depicted in FIG. 5 to produce promotional pieces;

FIG. 7 is a perspective view of a pop-up promotional piece made from the blank shown in FIG. 5;

FIG. 8 is a view, generally similar to FIG. 7, of another alternative embodiment of a promotional piece that can be produced by a method incorporating various features of the invention; and FIG. 9 is a view of a continuous web that may be employed to produce the promotional piece of FIG. 8.

DETAILED DESCRIPTION OF THE PREFERRED EMBODIMENTS

FIG. 1 is a perspective view of a promotional piece 9 which can be formed from a continuous web 11, and FIG. 2 shows a region of the continuous web 11, as it may be running on a web-printing press or the like, which region depicts a single printed blank 13 that has been appropriately preliminarily die-cut and which will eventually form the promotional piece 9 that is illustrated in FIG. 1. The blank 13 is demarcated, for purposes of illustration, by a pair of dot-dash lines 17 that extend transversely to the direction of movement of web which is shown by the arrow, and which indicate the lines along which each folded blank will be severed from the next adjacent blank after fabrication is complete. Also shown in FIG. 2 is a dot-dash line 15, along which a longitudinal severing will occur during the handling of the blank, and five dotted lines **16*a*–16*e*** along which folding of the web will occur. Such dotted lines may be actually be formed as lines of weakness in the web, as for example by pressing, scoring or slightly perforating as a part of the die-cutting operation; alternatively, they may be omitted and left to be formed as a result of the subsequent folding operations. It is generally satisfactory to simply rely upon the natural resiliency of the paper web to effect appropriate bending as a result of the placement of an adjacent line of adhesive without actually providing any line of weakness; however, lines of weakness are generally preferred because of the creation of a neater appearance in the final product.

The same die-cutting and adhesive application steps are effected with respect to each of the successive blanks 13 of the continuous, sheet material web, which is preferably made of a suitable paper or paperboard material, glossy or matte finish as desired, but which might possibly be an appropriate plastic sheet material. As a part of the adhesive application step, a glue line 19*a* which generally extends longitudinally of the web is preferably applied to the upper surface of the web, as illustrated in FIG. 2. If desired, one or more of such glue lines could be applied to the undersurface of web, or they could be applied at a later stage during the fabrication process, as is done in this case. Although these are commonly referred to in the trade as glue lines, any suitable adhesive can be used in the fabrication process, such as a hot-melt or a solvent-based adhesive. Moreover, a heat-activated adhesive or an ultrasonic-activated adhesive or even a water-based adhesive might instead be applied, either before or after die-cutting, as by printing onto the continuous web, and in such an instance, the adhesive character of such printed glue lines may be sequentially activated, if desired, to effect specific attachment between specific parts by subjecting one or more of such glue lines to heat or ultrasonic energy or moisture spray, as appropriate, to activate such previously-applied adhesive. Alternatively, a final activation step could be carried out to finalize attachment at all lines of heat or ultrasonic activated adhesive. Although the glue line 19*a* is shown in FIG. 2 as having been applied to the web either before, during or after the die-cutting operation but before further manipulation takes place, this is optional, and it is acceptable for the glue line 19*a* to also be applied at a later stage of the fabrication process after the web has been slit into multiple ribbons.

More specifically, in the embodiment shown in FIG. 2 a die-cutting operation is employed to create a first die-cut 21 which forms the upper edge of what will constitute a hidden pop-up panel 23 in the ultimate promotional piece 9.

As will be explained hereinafter, a second die-cutting step is carried at a later stage after severing and folding a section of the web. The initial die-cut occurs along the left-end edge of the web and creates a series of spaced head parts 25 along a free edge of the pop-up panel 23, which head parts are separated from one another by short shoulder portions 25*a* which are aligned generally parallel to direction of the longitudinal movement of the web. Located in the web adjacent the right hand edge of the hidden pop-up panel 23 are two additional pop-up panels 27 and 29 which are hinged to each other along the dotted line 16*c*. The wider pop-up panel 27 is divided by the dotted line 16*b* to include a subpanel 27*a*, and the narrower pop-up panel 29 is divided by the dotted line 16*d* to include a subpanel 29*a*. The right hand section of the web forms a pair of basepieces 31 and 33 which are hinged to each other along a line 16*e*. The glue line 19*a*, which is shown in FIG. 2 as a speckled representation, is exaggerated and depicted in solid black in FIGS. 3A through 3E so that this and the other glue lines will better stand out in these diagrammatical illustrations.

As shown in FIG. 3A, the integral web 11 is slit longitudinally along the line 15 to form two ribbons using conventional slitting techniques. The left hand ribbon constitutes the three pop-up panels, and the right hand ribbon constitutes the two basepieces. The left hand portion of the pop-up ribbon constituting the series of pop-up panels 23 is folded onto the remainder of the ribbon as depicted. The folding can be carried out simultaneously with the slitting operation, or the slitting can either precede or follow the folding step.

Next, as depicted in FIG. 3B, the once-folded pop-up ribbon is further manipulated so as to fold the superimposed panels 23 and 27 along the line 16*c* so they overlie the remainder of the ribbon which constitutes the series of pop-up panels 29. Alternatively, the right hand portion of the ribbon constituting the pop-up panel 29 could be folded over the superimposed panels 23 and 27, and the twice-folded ribbon either turned 180° during the next step or placed upon the other basepiece.

Following this folding step, a die-cutting step is carried out along the edge of the folded ribbon as illustrated in FIG. 3C, which die-cutting removes four sets of interconnected rectangles from panels 27 and 29 (as indicated in dotted outline in FIG. 2). This results in the creation of four spaced-apart apertures 35, which apertures are centered precisely along the line 16*a* and are aligned with the four head parts 25 of the hidden pop-up panel 23.

As earlier indicated, if the line of adhesive 19*a* was not earlier applied, it should be applied to the panel 31 at this point. The twice-folded and die-cut pop-up ribbon is then shifted to the right into its desired position upon the basepiece 31, with the line of adhesive 19*a* in alignment with the subpanel 29*a* of the narrower pop-up panel 29. Once the folded ribbon is in place, an additional two lines of adhesive 19*b* and 19*c* (or a proportionally thicker line of adhesive) are applied to the upper surface of the subpanel 27*a* of the wider pop-up panel 27, as shown in FIG. 3D. Alternatively, the lines of adhesive 19*b* and 19*c* could have been applied to the basepiece 33 at the time of the application of the line of adhesive 19*a*, preferably while it was still a part of the integral web.

Thereafter, the portion of the ribbon constituting the basepiece 33 is folded over the pop-up ribbon to sandwich the pop-up structure between the two basepieces as depicted in FIG. 3E. If desired, the completely folded continuous web is then passed through compression rolls or the like to assure that a strong adhesive joinder is obtained. The left hand edge of the folded web can than be trimmed, as illustrated in FIG. 3E, by a suitable blade so that the two free edges of the basepieces are in clean alignment with each other. Finally, the web 11 is severed transversely, as diagrammatically indicated in FIG. 3F, to separate the continuous web into a plurality of structurally identical, flat-folded, promotional pieces of identical construction. Optionally, the left hand edges could be trimmed following severing into individual promotional pieces to provide the desired smooth edge which the recipient will usually grasp to open the piece.

From comparing FIGS. 1 and 4A, it can be seen that, upon the opening of the promotional piece 9, an attractive pop-up structure is displayed, with the initial view being of the printed scene on the two basepieces plus the tunnel-like construction that is presented by the hinged together wide and narrow pop-up panels 27, 29, with the four sharply defined apertures 35 prominently in view along the hinged edge therebetween. As the opening movement of the two basepieces continues, which is a relative pivoting movement along the straight hinge line 16*e*, the four head parts of the hidden panel 23 protrude through the apertures, changing the scene in an attention-attracting display. This protruding movement is halted when the shoulders 25*a* engage the hinge line 16*c* between the two panels, as seen in FIG. 4B, and any further relative movement that would tend to increase the amount of protrusion is simply taken up by bowing in the main body portion of the hidden panel 23.

By die-cutting the apertures along the edge of the folded web, a tunnel-like construction having attractive apertures which extend into two hinged panels becomes possible whereas it would not have been possible to fold along a notched edge using conventional means. Thus, the invention provides a fabrication method for producing an attractive promotional or advertising piece or the like from a continuous web of sheet material from a web printing press which is particularly efficient and which allows the mass production of a complicated, multi-panel pop-up structure in an extremely economical manner, using manipulative operations which have become quite reliable and precisely reproducible and which can be carried out as a part of a web-press operation.

Instead of locating the two basepieces adjacent each other in the blank and utilizing the natural hinge line that is provided by folding the web material along the straight line that demarcates the two basepieces to create the straight hinge line along which the two basepieces are swung open in the finished promotional piece, a false backbone can be created to provide such a hinge line or axis. Depicted in FIG. 5 is a web 51 printed to contain a plurality of blanks 53 adapted to form promotional pieces 55 wherein the basepieces are interconnected by a false backbone to provide the straight hinge line or axis along which opening movement occurs. The blank 53 is laid out with basepieces 61 and 63 located generally centrally, and it is designed to be cut into three ribbons along the lines 57*a* and *b* where longitudinal severing occurs. The blank is provided with three continuous lines of weakness 59*a*, *b* and *c*, as shown in FIG. 5. The false backbone is preferably defined by a transverse line of weakness 59*d* which extends completely across the web, although if desired, this line of weakness could be omitted; however, its presence provides a sharper, ultimate design by precisely defining the straight hinge line along which the basepieces pivot upon opening of the ultimate piece. The blank 53 includes two pairs of pop-up panels 65, 67 and 69, 71, respectively, which are arranged in flanking relationship to the basepieces 61 and 63. The line of weakness 59*a* defines a hinge line between the pop-up panels 65 and 67, and the line of weakness 59*c* defines a hinge line between the pop-up panels 69 and 71. For purposes of illustration, each of the pairs of pop-up panels is imprinted with a symmetrical object which, in this instance, is a tree, the outlines of which are shown in broken lines in FIG. 5. Glue patterns 73*a* through 73*e* are laid down at this time, although as earlier indicated, all or some of the adhesive can be applied at later stages of the manipulation process if desired. For example, the four triangular glue patterns, or lines along each hypotenuse thereof, might be applied at a later stage of fabrication.

As shown in FIG. 6A, the web is slit along the lines 57*a* and 57*b* to create the three ribbons which respectively include a left hand ribbon containing the pop-up panels 65 and 67, a central ribbon containing the basepieces 61 and 63, and a right hand ribbon containing the pop-up panels 69 and 71. As depicted in FIG. 6B, the right hand and left hand ribbons are folded in half, respectively along the lines of weakness 59*c* and 59*a*, to create ribbons of double thickness. Alternatively, if desired, the folding could be effected prior to the severing step. At the time of the folding of the ribbons along the common centerlines, the pop-up panels 65 and 67 and the panels 69 and 71, respectively, become affixed to each other as a result of the presence of the glue pattern 73*a* in the region of the false backbone. Next, as diagrammatically depicted in FIG. 6C, a die-cutting operation is carried out along the free edges of the narrower ribbons opposite from folded edges, i.e., along the outer edges of both of the folded, double-thickness ribbons. This die-cutting is carried out along the outline of the tree so as to create a symetrical pop-up structure in which the panels 69 and 71, for example, are mirror images of each other. The trim from the die-cutting is stripped from the outer edges of the right hand and left hand ribbons, and the double thickness of the ribbon permits greater tension to be maintained in the web which allows for higher running speed.

As depicted in FIG. 6D, the ribbons are then displaced onto the central ribbon and located atop the portion thereof which constitutes the basepiece 63. Moreover, the panel 71 of the right hand ribbon is aligned with the triangular-shaped adhesive pattern 73*e*, and the left hand ribbon is aligned so that the underlying pop-up panel 65 is placed atop the triangular-shaped adhesive pattern 73*d*. As a result, there is adhesive joinder between the basepiece 63 and the pop-up panels 65 and 67 by the adhesive in the pattern 73*a* in the region of the backbones and by the triangular-shaped patterns 73*d* and 73*e*.

Next, as depicted in FIGS. 6D and 6E, the basepiece 61 is folded about the central line of weakness of the web, the line 59*b*, so as to superimpose it atop the basepiece 63, sandwiching both of the pop-up structures therebetween. If the glue patterns 73*b* and 73*c* were not earlier applied to the basepiece 61, they could optionally be applied at this time to the pop-up panels 67 and 69. As a result of this final folding step, the false backbone is completed by the adhesive pattern 73*a* along the trailing edge of the basepiece 61, and there is a further interconnection established between the basepiece 61 and the pop-up panels 67 and 69 by means of the triangular glue patterns 73*b* and 73*c*, respectively, which are carried by the basepiece 61. Next, as depicted in FIG. 6F, the left hand edge of the folded web is trimmed or severed to remove the hinge line 69*b*, and preferably, a cleanup trim is effected along the right hand edge. An optional compression step may be carried out to assure strong joinder is achieved at the regions of adhesive, and the folded web is then cut transversely to produce the structurally identical promotional pieces 55.

When the piece 55 is opened, as shown in FIG. 7, by pivoting the basepieces 61 and 63 relative to each other along the composite straight line provided by the line of weakness 59*d* at the edge of the false backbone the two pop-up structures move away from the respective planes of the basepieces as a result of their affixation by the triangular glue patterns 73*b*–*e* and are prominently displayed, extending, as shown in FIG. 7, in slightly diverging relationship to each other. The pop-up panels 69 and 71 illustrate symmetrical halves of a tree, and the ability to contour both edges of the ultimate structure provides a striking artistic effect. Moreover, using conventional mass production methods, it is not possible to fold a ribbon having a width of about 2 inches or less, which the present invention avoids. Furthermore, folding of a ribbon becomes difficult when die-cutting produces regions where there is a transition from a narrow region to a wide region wherein the width of the wide region, measured from the line along which folding is to occur, is 2 or more times the width of the narrow region; again, the present method avoids such complications which would otherwise necessitate running at substantially slower speeds.

FIG. 8 is a perspective view, generally similar to FIG. 7, showing still another alternative version of a promotional piece. The item 75 includes a pair of basepieces 77 and 79 and a pop-up structure 81 in the form of a pair of hinged together panels 83 and 85. The pop-up structure 81 is of particularly unusual artistic design for a piece 75 that can be produced on a mass production basis from a continuous web. A suitable web 87 is illustrated in FIG. 9 wherein a series of blanks 89 of similar structural configuration are formed, which web is laid out so that the pop-up panels 83 and 85 are located to the left of the basepieces 77 and 79. A typical manufacturing method might sever the web into two ribbons along the line 91 and then fold the narrower ribbon containing the pop-up panels 83 and 85 along the line of weakness 93*a* so that the panel 83 is superimposed upon the panel 85. In this position, the two panels are interconnected by an adhesive pattern 95*a* either having the general configuration of the outline of the head portion of the pop-up structure or a plurality of strategically located individual strips, which pattern 95*a* is applied to the pop-up panel 85. The folded left hand ribbon, which has been folded along the line of weakness 93*a*, is then die-cut along both of its edges, i.e., the folded edge and the opposite edge, to produce the artistic figure outlined in broken lines in FIG. 9. Following such die-cutting and the removal of trim, the narrowed ribbon is displaced to a location over the wider ribbon, and again the double thickness of the die-cut narrower ribbon allows a greater tension to be maintained in the web. The die-cut ribbon is placed on the basepiece 79 with the hinged edge of the pop-up structure 81 that is defined by the fold line 93*a* being aligned with the line of weakness 93*b*. As a result, there is an affixation of the pop-up panel 85 to the basepiece 79 by the generally triangular adhesive pattern 95*c*. Thereafter, the wider ribbon is folded along the line of weakness 93*b* so that the basepiece 77 is superimposed atop the basepiece 79 sandwiching the pop-up structure therebetween and effecting the further adhesive attachment between the basepiece 77 and the pop-up panel 83 by the generally triangular glue pattern 95*b*. As in the case of the other manufacturing methods described above, the right hand or free edge of the ribbon can be trimmed to present a clean appearance, and the usual compression and transverse severing steps can be effected to cut the continuous web into a plurality of identical promotional pieces 75.

When the basepieces 77 and 79 are opened by pivoting along the hinge line 93*b*, the pop-up structure 81 rises up from the planes of the basepieces to present a striking artistic appearance which is particularly designed to attract the attention of the recipient who opens the piece and thus cause the promotional message that is carried by the piece to be read and remembered.

Although the invention has been described in respect of a number of preferred embodiments, which constitute the best mode known by the inventor for carrying out the invention, it should be understood that changes and modifications as would be obvious to one having the ordinary skill in this art may be made without deviating from the scope of the invention which is defined by the appended claims. Although reference has been frequently made to web-press operation as indicating that the design is capable of fabrication of a continuous web as it comes from a web press, if desired, the web could be re-rolled and then fabricated at a later time and, optionally, at a different speed. The series of blanks in each web are described as being structurally identical because, if desired, alternating blanks, for example, could be printed differently and possibly slightly different shaped head parts could be die-cut. Moreover, it should be understood that various of the folding operations that are illustrated could be replaced by severing a ribbon and then displacing it laterally. Furthermore, some die-cutting of one or both of the pop-up panels, in regions other than along the fold line, can be carried out before the initial folding step. Particular features of the invention are emphasized in the claims which follow.

I claim:

1. A method of making pieces containing a pop-up structure from a continuous web, which method comprises steps of:

providing a continuous web of printed sheet material designed to produce a series of interconnected blanks each extending transversely of said continuous web, said blanks each including a pair of basepieces and a pair of pop-up panels which pop-up panels are connected to each other along a common line, applying adhesive to selective locations on said moving web;

manipulating a portion of said web so that one pop-up panel at least partially overlies the other pop-up panel creating a double-thickness portion of said web, die-cutting said double-thickness portion of said web along a contoured line to create at least one similarly contoured edge along both said pop-up panels without at the same time cutting the web portion constituting said basepieces, displacing said die-cut pop-up panels having said similarly contoured edges to position them atop one of said basepieces, thereafter manipulating said web to superimpose said basepieces atop each other with said pop-up panels sandwiched therebetween, and cutting said web transversely of the series of manipulated blanks to create a plurality of structurally identical flat individual pieces each containing a pop-up structure that moves away from the respective planes of both basepieces when piece is opened by pivoting said basepieces along a straight hinge line of interconnection therebetween, said pop-up panels forming a construction wherein said similarly contoured edges of the pop-up structure present an attractive appearance.

2. A method according to claim 1 wherein said web is folded along said common line so that one pop-up panel overlies the other.

3. A method according to claim 2 wherein said die-cutting is carried out along said common line.

4. A method according to claim 2 wherein said die-cutting is carried out along an edge opposite from the edge defined by said common line.

5. A method according to claim 2 wherein said die-cutting is carried out along the edge defined by said common line and along the opposite edge.

6. A method according to claim 1 wherein said basepieces are adjacent each other in said blank and said web is folded to superimpose one basepiece atop the other.

7. A method according to claim 6 wherein said adhesive pattern creates a false backbone between said superimposed basepieces which provides said straight hinge line of interconnection.

8. A method according to claim 6 wherein said die-cut pop-up panels are displaced to position them adjacent the line along which said basepieces are folded and which constitutes said straight hinge line of interconnection.

9. A method of making pieces containing a pop-up structure from a continuous web, which method comprises steps of:

providing a continuous web of printed sheet material designed to produce a series of interconnected blanks each extending transversely of said continuous web, said blanks each including a pair of basepieces and a pair of pop-up panels which panels are connected to each other along a common line, applying adhesive to selective locations on said moving web including one of said pop-up panels;

folding a portion of said web so that one pop-up panel at least partially overlies the other pop-up panel creating a double-thickness portion of said web, severing said web into at least two parts, one of which contains said pair of pop-up panels, die-cutting said double-thickness portion of said web along a contoured line to create at least one similarly contoured edge along both said pop-up panels without at the same time cutting the web portion constituting said basepieces, displacing part of said web containing said die-cut pop-up panels having said similarly contoured edges to position them atop one of said basepieces, thereafter manipulating said web to superimpose said basepieces atop each other with said pop-up panels sandwiched therebetween, and cutting said web transversely of the series of manipulated blanks to create a plurality of structurally identical flat individual pieces each containing a pop-up structure that moves away from the respective planes of both basepieces when piece is opened by pivoting said basepieces along a straight hinge line of interconnection therebetween, said pop-up panels forming a construction wherein said similarly contoured edges of the pop-up structure present an attractive appearance.

* * * * *